US008201640B2

(12) United States Patent
Andersson

(10) Patent No.: US 8,201,640 B2
(45) Date of Patent: Jun. 19, 2012

(54) METHOD IN RESPECT OF A PERCUSSIVE DEVICE, PERCUSSIVE DEVICE AND ROCK DRILLING MACHINE

(75) Inventor: Kurt Andersson, Tyresö (SE)

(73) Assignee: Atlas Copco Rock Drills AB, Orebro (SE)

( * ) Notice: Subject to any disclaimer, the term of this patent is extended or adjusted under 35 U.S.C. 154(b) by 197 days.

(21) Appl. No.: 12/448,969

(22) PCT Filed: Jan. 23, 2008

(86) PCT No.: PCT/SE2008/000054

§ 371 (c)(1),
(2), (4) Date: Jul. 16, 2009

(87) PCT Pub. No.: WO2008/103095

PCT Pub. Date: Aug. 28, 2008

(65) Prior Publication Data

US 2009/0321100 A1 Dec. 31, 2009

(30) Foreign Application Priority Data

Feb. 23, 2007 (SE) ..... 0700451-8

(51) Int. Cl.
*E21B 7/00* (2006.01)

(52) U.S. Cl. ..... 173/1; 173/113; 173/200; 173/207

(58) Field of Classification Search ..... 173/1, 13, 173/90, 112, 113, 114, 200, 206, 207, DIG. 4; 91/239, 321
See application file for complete search history.

(56) References Cited

U.S. PATENT DOCUMENTS

| | | | | | |
|---|---|---|---|---|---|
| 3,741,316 | A | * | 6/1973 | Alajouanine | 173/107 |
| 3,774,502 | A | * | 11/1973 | Arndt | 91/246 |
| 4,006,783 | A | * | 2/1977 | Granholm | 173/177 |
| 4,413,687 | A | | 11/1983 | Eklof | |
| 4,858,702 | A | | 8/1989 | Piras | |
| 4,899,836 | A | * | 2/1990 | Vernot | 173/207 |
| 5,372,196 | A | * | 12/1994 | Andersson | 175/296 |
| 5,653,295 | A | * | 8/1997 | Juvonen et al. | 173/208 |
| 5,669,281 | A | | 9/1997 | Comarmond | |
| 5,979,291 | A | * | 11/1999 | Juvonen | 91/239 |
| 6,371,222 | B1 | * | 4/2002 | Andersson et al. | 175/135 |

FOREIGN PATENT DOCUMENTS

| | | |
|---|---|---|
| GB | 1219546 | 1/1971 |
| GB | 1584810 | 2/1981 |
| WO | WO 2006/043866 A1 | 4/2006 |
| WO | WO 2006/137775 A1 | 12/2006 |
| WO | WO 2006/137776 A1 | 12/2006 |

* cited by examiner

*Primary Examiner* — Lindsay Low
*Assistant Examiner* — Andrew M Tecco
(74) *Attorney, Agent, or Firm* — Mark P. Stone

(57) ABSTRACT

A method for controlling a fluid operated percussive device, which inside an axially extending cylinder room (3) of a housing (2) of the percussive device includes a to and fro moveable percussive piston (1), which is adapted for performing strikes in a striking direction (A) and which includes a signal portion (4) for controlling a main valve (5), which is adapted to intermittently transmit pressure fluid to at least one driving chamber (7) for the percussive piston. An auxiliary valve (9) is controlled for transmitting fluid contact between at least one auxiliary channel means (13,14) with a channel opening in the cylinder room (3), and the main valve (5) over the signal portion (4), for switching the main valve (5) before the percussive piston, in operation, has reached at least one of said regions. The invention also concerns a percussive device and a rock drilling machine.

28 Claims, 6 Drawing Sheets

METHOD IN RESPECT OF A PERCUSSIVE DEVICE, PERCUSSIVE DEVICE AND ROCK DRILLING MACHINE

FIELD OF THE INVENTION

The invention concerns a method for controlling a fluid operated percussive device according to the preamble claim 1 and a fluid operated percussive device. The invention also concerns a rock drilling machine including such a percussive device.

BACKGROUND OF THE INVENTION

From WO2006/043866 (Atlas Copco Rock Drills AB) is previously known a valve controlled hydraulic percussive device which in principle works according to the following. When the percussive piston has performed a stroke, it is driven backwardly by hydraulic force supplied to a forward drive face. When the piston has moved a certain predetermined distance, the so called signal point is reached. A circumferentially extending groove in the percussive piston which has previously connected a high pressure channel with a signal conduit of a main valve at this point instead establishes a connection between the signal conduit and a draining conduit.

This result in that the spool of the main valve starts to switch and, as seen in the Figure in said document, move to the right, driven by a permanent, high pressure on the left driving surface of the valve spool. When the spool thereafter reaches a central position, the pressure thereby switches on the right side of the percussive piston from return pressure into high pressure, whereby the percussive piston is retarded in order to subsequently start a movement in the striking direction, to the left in the Figure of said document. When the groove in the piston again reaches the high pressure channel, the signal conduit on the main valve is again pressurized and the valve spool again starts to switch and thereby move to the left, as seen in the Figure.

The percussive device is dimensioned such that when the percussive piston hits the shank adapter, at the striking moment, the spool of the main valve has reached its central position and the high pressure on the right side of the percussive piston has again changed into return pressure (or low pressure), whereon a percussive cycle can be repeated.

This previously known percussive device works reliably and well, but has a limitation in theoretically reachable stroke frequency.

AIM AND MOST IMPORTANT FEATURE OF THE INVENTION

It is an aim of the present invention to provide a percussive device according to the above, which makes operation possible with higher striking frequency than with previous conventional percussive devices of this kind.

This aim is obtained in a method and a device according to the above through the features of the respective characterizing portions of the independent claims.

With the conventional technology according to the above, the spool switching time, which is the time period from signal to switched spool, has been made as short as possible. This time period is influenced by parameters such as drive surfaces, channel areas, spool weight, spool stroke length. Further, the percussive piston speed is also given. Considering these parameters, the smallest possible distance or the signal point from the striking position can be established. Since the signal point at spool switching, during the movement of the piston opposite to the striking direction, for geometrical reasons can not go below a minimal length and the spool switching time is given, the percussive device will be given a shortest stroke length and thereby the percussive device be given a maximal stroke frequency.

With the valve system according to the background art, it is therefore not possible, under given conditions, to increase the striking frequency.

Through the invention, wherein an auxiliary valve is included into the system, this limitation can be avoided, whereby a striking length can be reduced and the frequency increased.

By controlling the auxiliary valve in order to transmit fluid contact between at least one auxiliary channel means with a channel port in the cylinder room and the main valve via the signal portion for switching the main valve before the percussive piston has reached the respective end region, the switching signal to the main valve can be transmitted earlier without having to take into account the above mentioned constructional dimensioning of the percussive device. This results in several advantages which on the one hand generally concerns the benefit of a higher striking frequency in a percussive device of this type, on the other hand the possibility of dimensioning the percussive piston with less weight in respect of its function for achieving high striking frequencies.

It is preferred that the auxiliary valve is controlled by the pressure in said drive chamber, whereby it is ensured that the auxiliary valve is switched to the desired function when the percussive piston is driven in the driving direction for the respective driving chamber. In particular it is preferred that the auxiliary valve is controlled by the pressure in a rear drive chamber of the percussive piston being provided for driving the percussive piston in the striking direction. A counteracting return chamber can hereby be permanently pressurized whereas the rear driving chamber in that case is pressurized intermittently.

In particularly it is preferred that the auxiliary valve is controlled in order to transmit said fluid contact for 5 switching the main valve for the movement of the percussive piston in the direction of the one as well as the other of said regions, which means that the fluid contact through the auxiliary valve is transmitted for, on the one hand, the movement in the striking direction, and on the other hand, the movement opposite to the striking direction. Hereby is given increased possibilities of minimizing the stroke length and thereby increasing the frequency.

Corresponding advantages are obtained through a fluid operated percussive device according to the invention and further inventive features are defined in the other dependent claims.

BRIEF DESCRIPTION OF DRAWINGS

The invention will now be explained in greater detail by way of embodiment being illustrated on the annexed drawings, wherein.

DESCRIPTION OF EMBODIMENT

Figure 1:
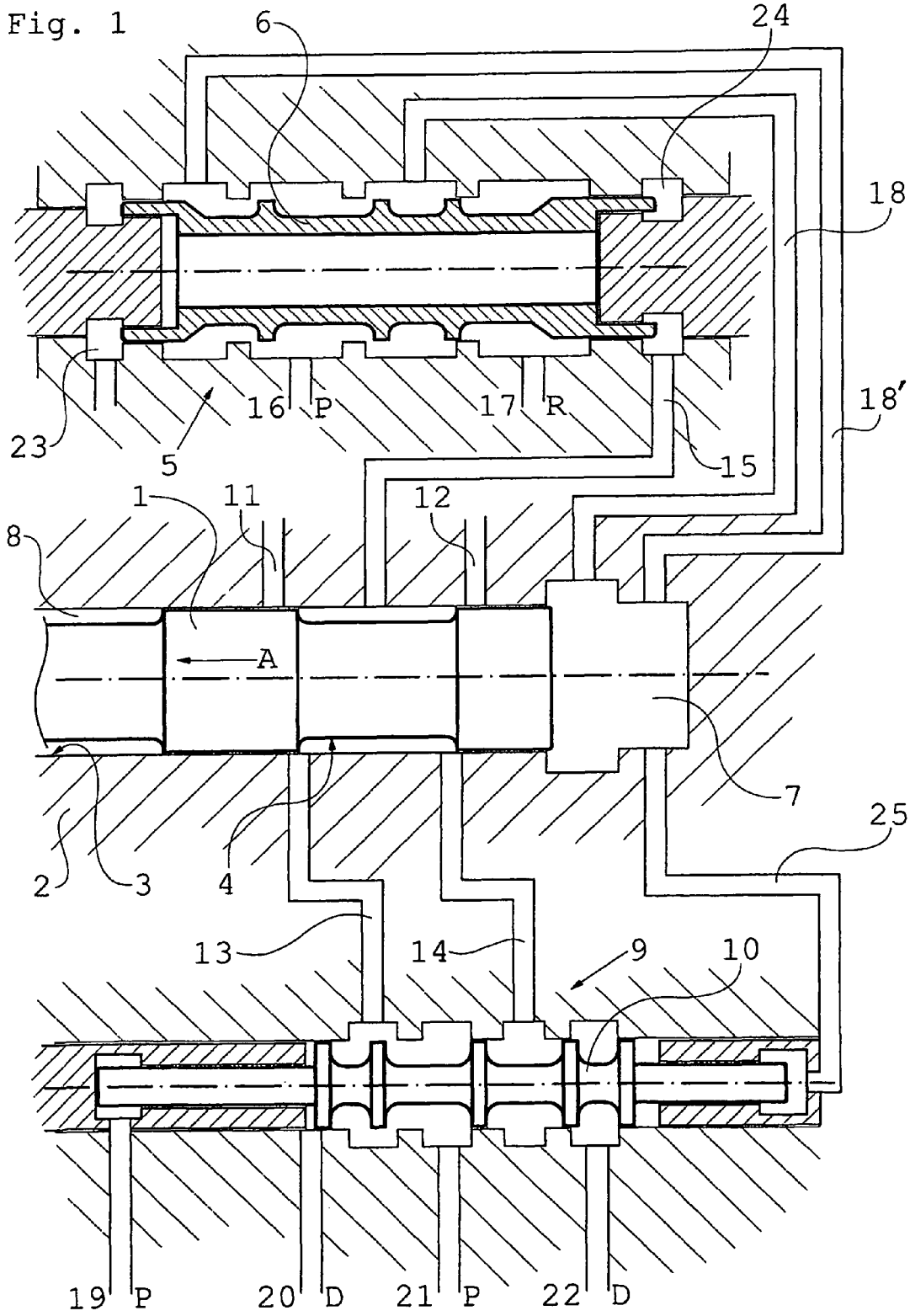
FIGS. 1-5 diagrammatically show a percussive device according to the invention in section in five different positions.

Numeral 1 on FIG. 1 indicates a percussive piston of a fluid operated percussive device which is shown diagrammatically and, dimensionwise, not according to scale. The percussive piston 1 is moveable to and fro in a cylinder room 3 of a housing 2 of the percussive device such that it in a striking direction A strikes onto, for example, a not shown drill shank or a drill adapter. Fluidum used is usually a hydraulic fluid such as hydraulic oil.

The percussive piston 1 is in a per se manner provided with a narrower signal portion 4, which functions as a valve spool, and which is arranged, in given position of the percussive piston, to transmit fluid conduit contact between different channels having openings into the cylinder room 3.

In the position shown in FIG. 1, the percussive piston 1 is heading in the striking direction A, to the left in the Figure, a rear driving chamber 7 being pressurized with pressure fluid by a main valve spool 6 of a main valve 5 being in a position where pressure fluid from a not shown pressure source over a pressure conduit 16 and over channels 18 and 18' is transmitted to the driving chamber 7. The pressure inside the driving chamber 7 thus exerts a driving force onto the percussive piston 1 in said striking direction A.

An auxiliary valve 9 with an auxiliary valve spool 10 is actuated by the pressure in the rear driving chamber 7 through a channel 25, said pressure pressing the auxiliary valve spool 10 to the left, as seen in the Figure, such that the pressure conduit 21 and a first auxiliary channel means 13, which opens into the cylinder room, are in fluid communication with each other. In the shown position, the channel opening of the first auxiliary channel means 13 has just opened after this channel opening having been covered by a portion of the percussive piston 1.

A signal chamber 24 of the main valve 5 has previously, when the percussive piston 1 was positioned somewhat more to the right than what it is in the shown position, over a signal conduit 15 been into contact with a draining conduit 12, which has an opening in the cylinder room 3, for the evacuation of this signal chamber 24. This has resulted in that the main valve spool 6 has been able to move in the direction to the right, into the position which is shown in FIG. 1, and open said connection between the pressure conduit 16 and the conduit 18 and 18'.

Figure 2:
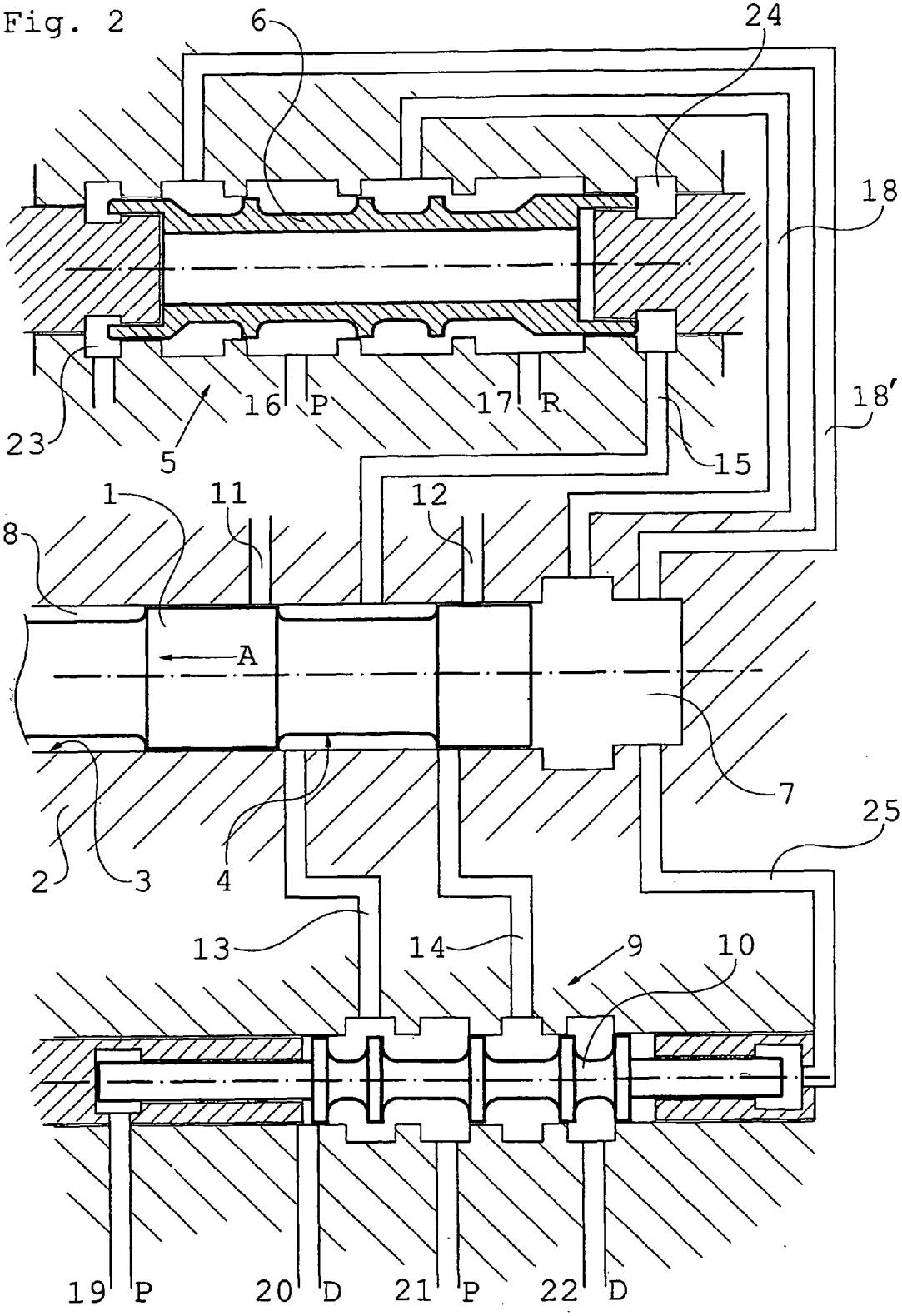

In FIG. 2, the percussive piston 1 has been driven further in the striking direction and entirely uncovered the channel opening of the first auxiliary channel means 13 in the cylinder room 3, whereupon high pressure fluid fully can be transferred over the signal portion 4 through the signal conduit 15 to the signal chamber 24. Hereby the main valve spool 6 has moved to the left, as seen in the Figure, and high pressure to the rear driving chamber 7 has been exchanged into contact between this chamber and the return conduit 17, resulting in low pressure in this chamber 7.

The continued movement of the percussive piston 1 in the striking direction A is now with decreasing pressure in the rear pressure chamber and with a constant pressure in a forward driving chamber 8. The percussive device is dimensioned such that the high speed moving percussive piston 1 with unreduced speed is allowed to move all the way forward to the striking position, before it has experienced any retardation because of changed force relations onto the percussive device. This is possible because of the prevailing inertia in the system which has been mentioned above, viz the setting speed for the main valve spool 6, resistance in conduits and channels etc.

Figure 3:
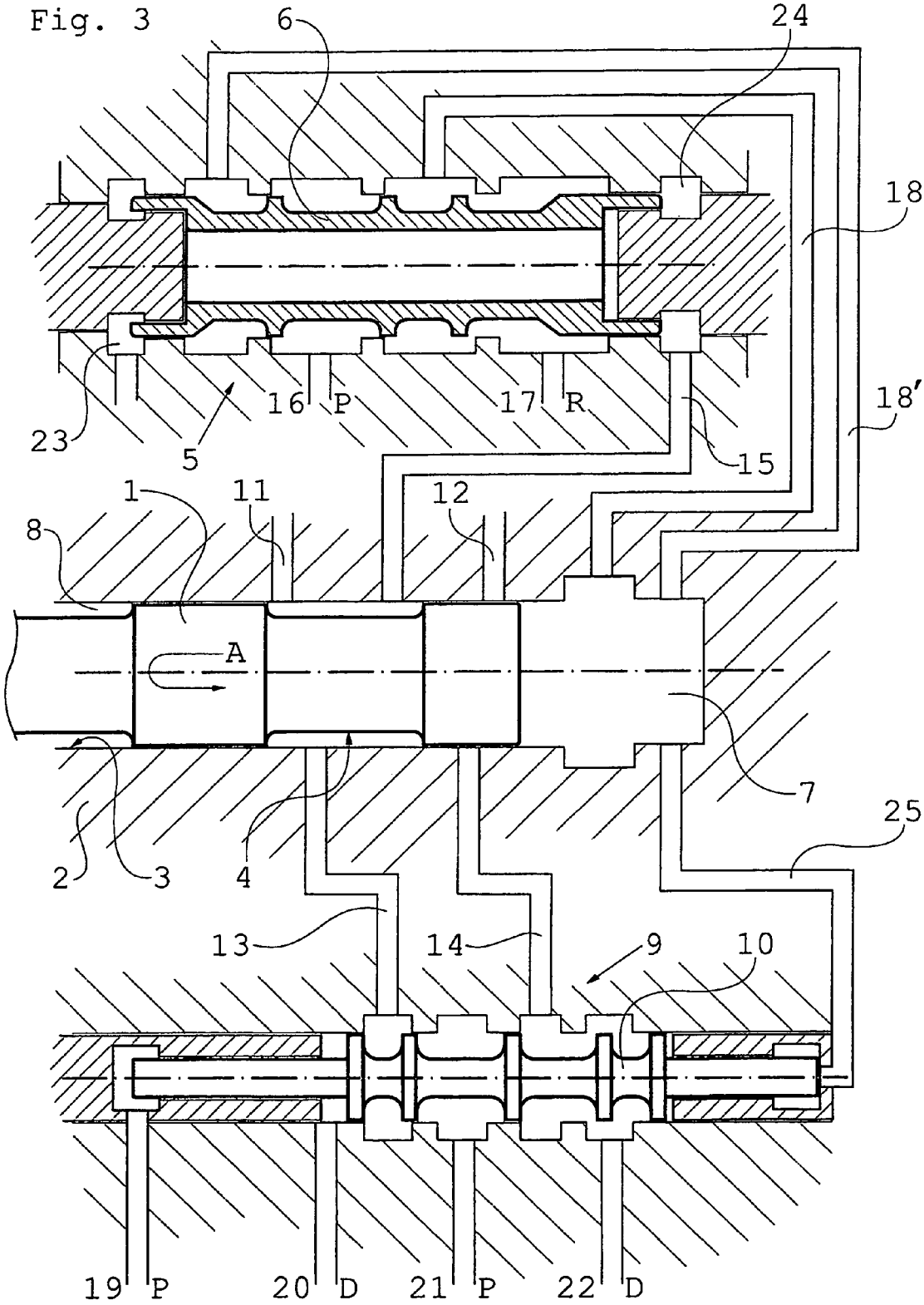

In the position shown in FIG. 2, the auxiliary valve spool 10 is no longer actuated by a high pressure in the direction to the left in its right chamber but only by the pressure against a piston portion of the auxiliary valve spool 10 inside a permanent pressure chamber, which is in connection with the pressure conduit 19, for resetting the auxiliary valve spool 10 to its right position, which has been reached in the position shown in FIG. 3 for the auxiliary valve spool 10, whereby high pressure is not any longer transmitted to the first auxiliary channel means 13, but instead the second auxiliary channel means 14 is connected to a draining conduit 22. A draining conduit 20 provides for draining a ring surface of the auxiliary valve spool 10.

FIG. 3 shows further the percussive device when the percussive piston 1 has reached further in the striking direction and is close to the striking position. The percussive piston is now positioned in the area of a second, forward end position of the percussive piston, whereby a permanently pressurized pressure conduit 11 is connected to the signal conduit 15 over the signal portion 4. The main valve is in the same position as in FIG. 2. In this region the percussive piston performs its strike.

Figure 4:
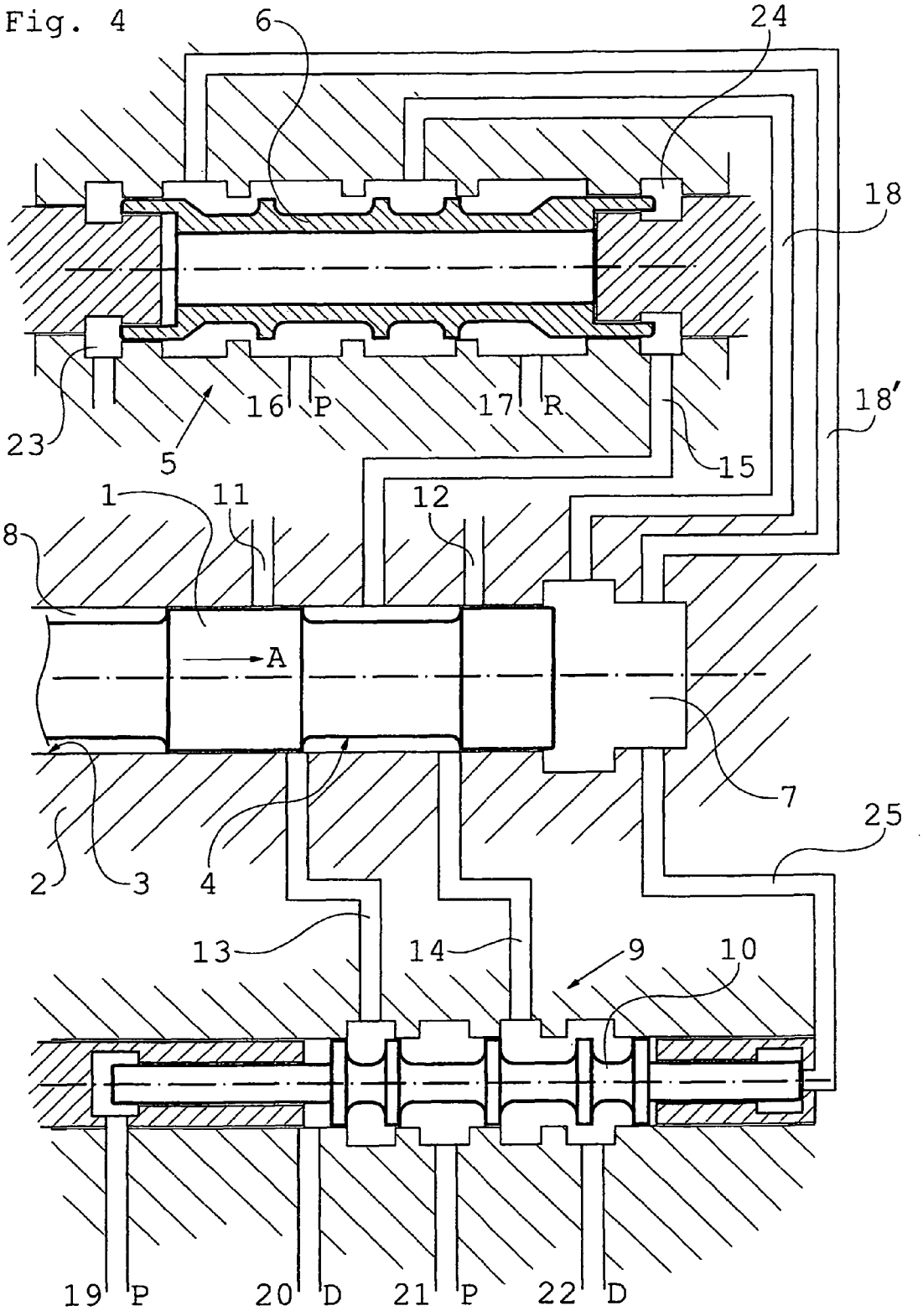

In FIG. 4 the percussive piston, because of the permanently pressurized forward driving chamber 8, has after the strike been driven in the direction opposite to the striking direction and reached a position where the second auxiliary channel means 14 is uncovered. This results in that the signal chamber 24 is drained over the signal conduit 15, the signal portion 4 and said second auxiliary channel means 14. Hereby the main valve spool 6 has been reset because of the permanent pressure in the chamber 23 on the left side of the slide and moved, as shown on FIG. 4, to the right in order to allow high pressure now to be transmitted to the rear driving chamber 7. This pressure in the rear driving chamber 7 will also actuate the auxiliary valve spool 10 for switching it to the left, as seen in the Figure, for closing the connection between a draining conduit 22 and the second auxiliary means 14 (this has not yet occurred in the position which is shown on FIG. 4). The percussive piston 1 now experiences a pressure increased in the rear driving chamber 7 and will decelerate in its movement but continue further a distance opposite to the working direction.

Figure 5:
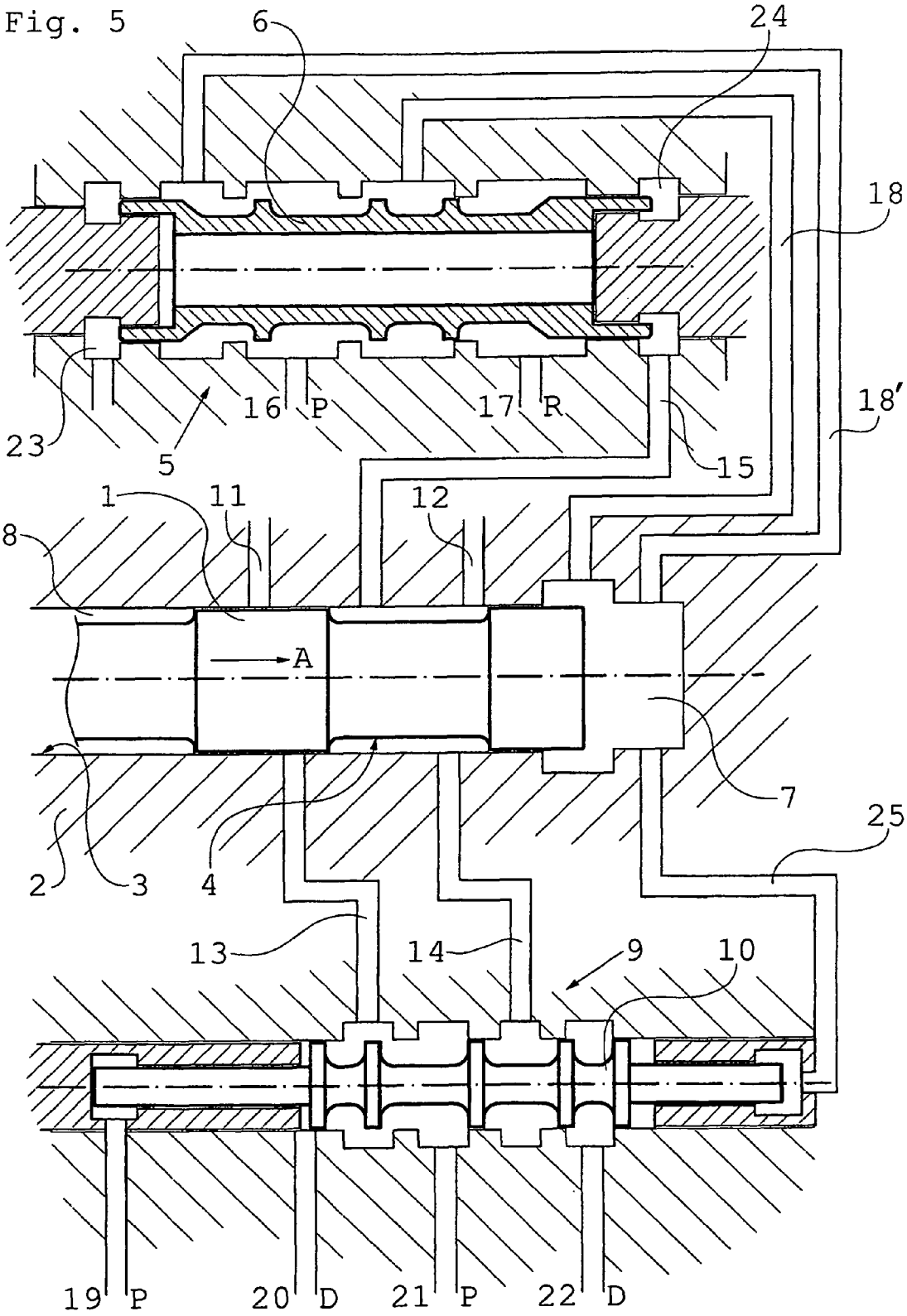

In FIG. 5 the percussive piston 1 has reached a position in the region of a first, rear end position of the percussive piston, where the signal conduit 15 has been put in connection with the permanent draining conduit 12. The main valve is in the same position as in FIG. 4, whereas the auxiliary valve, because of the pressure in the rear diving chamber 7, has been reset for blocking the connection between the draining conduit 22 and the second auxiliary channel means 14 and instead the first auxiliary channel means 13 has come into connection with the pressure conduit 21.

The percussive piston 1 will continue to decelerate and switch into movement in the striking direction in order to again reach the position which is shown in FIG. 1 for repeating the striking movement.

Figure 6:
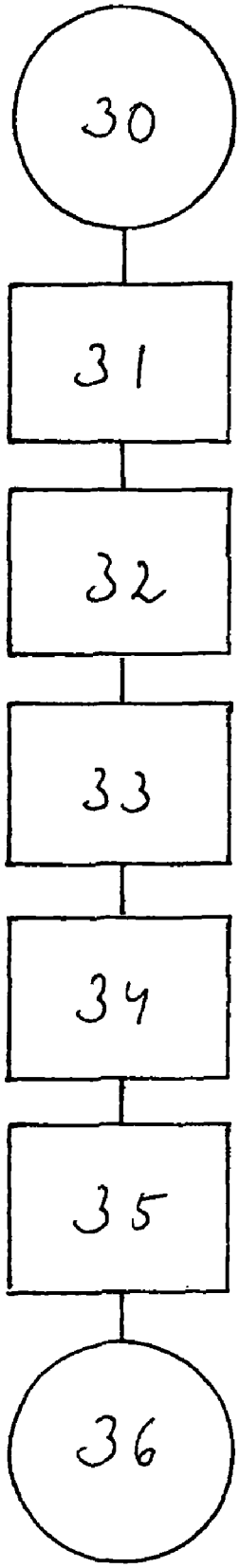
FIG. 6 shows a simplified block diagram over a method according to the invention.

With reference to FIG. 6 is now described a method sequence for controlling a percussive device.

Position 30 indicates the start of the sequence.

Position 31 indicates that the percussive piston 1 has reached the position in FIG. 1 with pressurizing of the rear driving chamber 7.

Position 32 indicates that the percussive piston 1 has reached the position in FIG. 2, that the pressure transmitted over the auxiliary valve 10 allows resetting the main valve 5 such that the rear driving chamber 7 is connected to return pressure.

Position 33 indicates that the percussive piston 1 has reached the position in FIG. 3 that is the region of a forward end position, wherein the pressure in the signal chamber 24 of the main valve 5 is maintained through the connection with a permanently pressurized pressure conduit and the signal portion.

Position 34 indicates that the percussive piston 1 has reached the position in FIG. 4, whereby the signal chamber 24 is drained. The main valve spool 6 is switched thereby in order to allow high pressure to start to be transmitted to the rear driving chamber.

Position 35 indicates that the percussive piston 1 has reached the position in FIG. 5, wherein the signal chamber 24 continues to be drained, the pressure increases in the rear driving chamber 7, the percussive piston 1 switches and moves in the striking directions A for repeating the striking cycle.

Position 36 indicates the end of the sequence.

The invention can be modified in the scope of the following claims. A solution can thus be envisaged where only one of the first and the second auxiliary channel means exist. It can also be envisaged that the percussive device is of the kind having intermittent pressurizing of a rear as well as of a forward driving chamber or having permanent pressurizing of the rear driving chamber and intermittent pressurizing of a forward driving chamber.

The arrangement for transmitting signals to the main spool can be different with signal channels to both sides of the main valve spool or signal transfer to the other side of the main valve spool. The arrangement with high pressure in conduit 11 and draining pressure in conduit 12 can be reversed.

Analogously with these variants and modifications, the auxiliary valve can be arranged otherwise and its output conduits be drawn differently and with the reverse function.

It is important to note that through the arrangement of the invention with an auxiliary valve, the switching signal to a main valve can be transmitted earlier than what is the case with the background part. This gives the possibility of having very short stroke lengths and thereby very high striking frequencies of a device according to the invention. As an example, at least a 50% frequency increase can be readily accomplished with simple means. Even greater frequency increases can be achieved.

Altogether, the signal for switching the main valve in the striking direction is thus lying closer to a rear end position for the percussive piston valve than is the case with a background art, whereas the signal for switching opposite to the striking direction is positioned closer to the striking position than what is the case of the background art.

Further, modifications can be had such as for example, which is per see known, to position a main valve spool coaxially with and surrounding a portion of the percussive piston.

The invention claimed is:

1. A method for controlling a fluid operated percussion device, which inside an axially extending cylinder room of a housing of the percussion device includes a to and fro moveable percussive piston, which is adapted for performing strikes in a striking direction and which includes a signal portion for controlling a main valve, which is adapted to intermittently transmit pressure fluid to at least one driving chamber for the percussive piston, whereby in the region of a first, rear end position of the percussive piston, the signal portion establishes a fluid conduit contact for setting the main valve for driving the percussive piston in the striking direction, and whereby in the region of a second, forward end position of the percussive piston, the signal portion establishes a fluid conduit contact for setting the main valve for driving the percussive piston opposite to the striking direction, wherein an auxiliary valve is controlled for transmitting fluid contact from a first auxiliary channel means, the first auxiliary channel means having a channel opening in the cylinder room, to the main valve by having the fluid pass through said channel opening of the first auxiliary channel means and the signal portion, so as to switch the main valve before the percussive piston, in operation, has reached the region of the first, rear end position of the percussive piston, and thereby before the signal portion has established said fluid conduit contact for setting the main valve for driving the percussive piston in the striking direction.

2. Method according to claim 1, wherein the auxiliary valve is controlled by the pressure in said driving chamber.

3. Method according to claim 1, wherein the main valve is controlled through a pressure signal being transmitted by the signal portion in forward positions as seen in the striking direction of the percussive piston.

4. Method according to claim 1, wherein in the region of the first, rear end position of the percussive piston, the signal portion establishes a fluid conduit contact between a draining conduit and the main valve.

5. Method according to claim 1, wherein the auxiliary valve is controlled for transmitting fluid contact also between a second auxiliary channel means, having a channel opening in the cylinder room, and the main valve over said channel opening of the second auxiliary channel means and the signal portion, for switching the main valve, before the percussive piston, in operation, has reached the region of the second, forward end position of the percussive piston, and thereby before the signal portion has established said fluid conduit contact for setting the main valve for driving the percussive piston opposite to the striking direction.

6. A method for controlling a fluid operated percussion device, which inside an axially extending cylinder room of a housing of the percussion device includes a to and fro moveable percussive piston, which is adapted for performing strikes in a striking direction and which includes a signal portion for controlling a main valve, which is adapted to intermittently transmit pressure fluid to at least one driving chamber for the percussive piston, whereby in the region of a first, rear end position of the percussive piston, the signal portion establishes a fluid conduit contact for setting the main valve for driving the percussive piston in the striking direction, and whereby in the region of a second, forward end position of the percussive piston, the signal portion establishes a fluid conduit contact for setting the main valve for driving the percussive piston opposite to the striking direction, wherein an auxiliary valve is controlled for transmitting fluid contact from an auxiliary channel means, the auxiliary channel means having a channel opening in the cylinder room, to the main valve by having the fluid pass through said channel opening of the auxiliary channel means and the signal portion, so as to switch the main valve before the percussive piston, in operation, has reached the region of the second, forward end position of the percussive piston, and thereby before the signal portion has established said fluid conduit contact for setting the main valve for driving the percussive piston opposite to the striking direction.

7. Method according to claim 6, wherein the auxiliary valve is controlled by the pressure in said driving chamber.

8. Method according to claim 6, wherein the main valve is controlled through a pressure signal being transmitted by the signal portion in forward positions as seen in the striking direction of the percussive piston.

9. Method according to claim 6, wherein in the region of the second, forward end position of the percussive piston, the signal portion establishes a fluid conduit contact between a pressure conduit and the main valve.

10. Fluid operated percussion device which includes, inside an axially extending cylinder room of a housing of the percussion device, a to and fro moveable percussive piston, which is adapted to perform strikes in a striking direction and which includes a signal portion for controlling a main valve, being arranged to intermittently transmit pressure fluid to at least one driving chamber for the percussive piston, whereby in the region of a first, rear end position of the percussive piston, the signal portion is arranged to establish a fluid conduit contact for setting the main valve for driving the percussive piston in the striking direction, and whereby in the region of a second, forward end position of the percussive piston, the signal portion is arranged to establish a fluid conduit contact for setting the main valve for driving the percussive piston opposite to the striking direction, an auxiliary valve which is controllable for transmitting fluid contact from a first auxiliary channel means, the first auxiliary channel means having a channel opening in the cylinder room, to the main valve by having the fluid pass through, said channel opening of the first auxiliary channel means and the signal portion, so as to switch the main valve before the percussive piston, in operation, has reached the region of the first, rear end position of the percussive piston, and thereby before the signal portion has established said fluid conduit contact for setting the main valve for driving the percussive piston in the striking direction.

11. Percussion device according to claim 10, wherein the auxiliary valve is controllable with the aid of the pressure in said driving chamber.

12. Percussion device according to claim 11, wherein the auxiliary valve is controllable by means of the pressure in a rear driving chamber for driving the percussive piston in the striking direction.

13. Percussion device according to claim 10, wherein the main valve is controllable through a pressure signal transmitted by the signal portion in forward positions of the percussive piston seen in the striking direction.

14. Percussion device according to claim 10, wherein the main valve is controllable by a release of pressure transmitted by the signal portion in retracted positions of the percussive piston, as seen in the striking position.

15. Percussion device according to claim 10, wherein said channel opening of said first auxiliary channel means is located in a position at an axial distance before the region of the first, rear end of the percussive piston, as seen in a movement direction of the percussive piston towards said region of the first, rear end position of the percussive piston.

16. Percussion device according to claim 10, wherein in the region of the first, rear end position of the percussive piston, a draining conduit is arranged, wherein the signal portion is arranged to establish a fluid conduit contact between the draining conduit and the main valve.

17. Percussion device according to claim 10, including means for controlling the auxiliary valve such that said first auxiliary channel means will be transmitting when the percussive piston is driven in a direction towards said first, rear end position of the percussive piston belonging to the first auxiliary channel means.

18. Rock drilling machine, including a percussion device according to claim 10.

19. Device according to claim 10, wherein the auxiliary valve is controllable for also transmitting fluid contact between a second auxiliary channel means having a channel opening in the cylinder room and the main valve, over said channel opening of the second auxiliary channel means and the signal portion, for switching the main valve before the percussive piston, in operation, has reached the region of the second, forward end position of the percussive piston, and thereby before the signal portion has established said fluid conduit contact for setting the main valve for driving the percussive piston opposite to the striking direction.

20. Fluid operated percussion device which includes, inside an axially extending cylinder room of a housing of the percussion device, a to and fro moveable percussive piston, which is adapted to perform strikes in a striking direction and which includes a signal portion for controlling a main valve, being arranged to intermittently transmit pressure fluid to at least one driving chamber for the percussive piston, whereby in the region of a first, rear end position of the percussive piston, the signal portion is arranged to establish a fluid conduit contact for setting the main valve for driving the percussive piston in the striking direction, and whereby in the region of a second, forward end position of the percussive piston, the signal portion is arranged to establish a fluid conduit contact for setting the main valve for driving the percussive piston opposite to the striking direction, an auxiliary valve which is controllable for transmitting fluid contact from an auxiliary channel means, the auxiliary channel means having a channel opening in the cylinder room, to the main valve by having the fluid pass through said channel opening of the auxiliary channel means and the signal portion, so as to switch the main valve before the percussive piston, in operation, has reached the region of the second, forward end position of the percussive piston, and thereby before the signal portion has established said fluid conduit contact for setting the main valve for driving the percussive piston opposite to the striking direction.

21. Percussion device according to claim 20, wherein the auxiliary valve is controllable with the aid of the pressure in said driving chamber.

22. Percussion device according to claim 21, wherein the auxiliary valve is controllable by means of the pressure in a rear driving chamber for driving the percussive piston in the striking direction.

23. Percussion device according to claim 20, wherein the main valve is controllable through a pressure signal transmitted by the signal portion in forward positions of the percussive piston seen in the striking direction.

24. Percussion device according to claim 20, wherein the main valve is controllable by a release of pressure transmitted by the signal portion in retracted positions of the percussive piston, as seen in the striking position.

25. Percussion device according to claim 20, wherein said channel opening of said auxiliary channel means is located in a position at an axial distance before the region of the second, forward end position of the percussive piston, as seen in a movement direction of the percussive piston towards the region of the second, forward end position of the percussive piston.

26. Percussion device according to claim 20, wherein in the region of the second, forward end position of the percussive piston, a pressure conduit is arranged, whereby the signal portion is arranged to establish a fluid conduit contact between the pressure conduit and the main valve.

27. Percussion device according to claim 20, including means for controlling the auxiliary valve such that the auxiliary channel means will be transmitting when the percussive piston is driven in a direction towards the second, forward end position of the percussive piston belonging to the auxiliary channel means.

28. Rock drilling machine, including a percussion device according to claim 20.

* * * * *

UNITED STATES PATENT AND TRADEMARK OFFICE

CERTIFICATE OF CORRECTION

PATENT NO. : 8,201,640 B2
APPLICATION NO. : 12/448969
DATED : June 19, 2012
INVENTOR(S) : Kurt Andersson It is certified that error appears in the above-identified patent and that said Letters Patent is hereby corrected as shown below:

Col. 7, Claim 10, Line 22: After “through”, delete “,”.

Signed and Sealed this
Seventh Day of August, 2012

David J. Kappos

David J. Kappos
*Director of the United States Patent and Trademark Office*